US006855245B1

(12) United States Patent
Reesink et al.

(10) Patent No.: US 6,855,245 B1
(45) Date of Patent: Feb. 15, 2005

(54) HYDROGENATION PROCESS

(75) Inventors: Bernard Hendrik Reesink, Doorn (NL); Willem Dijkstra, Jorwerd (NL); Pieter Hildegardus Berben, Maarn (NL); Marius Vaarkamp, Utrecht (NL)

(73) Assignee: Engelhard Corporation, Iselin, NJ (US)

( * ) Notice: Subject to any disclaimer, the term of this patent is extended or adjusted under 35 U.S.C. 154(b) by 0 days.

(21) Appl. No.: 09/744,134

(22) PCT Filed: Jul. 20, 1999

(86) PCT No.: PCT/NL99/00468

§ 371 (c)(1),
(2), (4) Date: Mar. 21, 1999

(87) PCT Pub. No.: WO00/05326

PCT Pub. Date: Feb. 3, 2000

(30) Foreign Application Priority Data

Jul. 22, 1998 (EP) ..... 98202466

(51) Int. Cl.[7] ..... C10G 45/00; C10G 65/02; C07C 5/02

(52) U.S. Cl. ..... 208/144; 208/143; 585/265

(58) Field of Search ..... 208/143, 144, 208/265; 585/265

(56) References Cited

U.S. PATENT DOCUMENTS

| | | | | |
|---|---|---|---|---|
| 3,796,654 A | | 3/1974 | Wilhelm | 208/139 |
| 3,950,243 A | | 4/1976 | Antos | 208/139 |
| 4,036,743 A | * | 7/1977 | Antos | 208/139 |
| 4,190,521 A | | 2/1980 | Antos | 208/139 |
| 4,738,771 A | * | 4/1988 | Miller et al. | 208/135 |
| 5,868,921 A | * | 2/1999 | Barre et al. | 208/57 |

FOREIGN PATENT DOCUMENTS

| | | |
|---|---|---|
| EP | 0 573 973 A1 | 12/1993 |
| EP | 0 573 973 A | 12/1993 |
| EP | 0 653 242 A1 | 5/1995 |
| EP | 0 653 242 A | 5/1995 |
| WO | WO 96 09360 A | 3/1996 |
| WO | WO 96/09360 | 3/1996 |
| WO | WO 97 03150 A | 1/1997 |
| WO | WO 97/03510 | 1/1997 |
| WO | WO 98 05739 A | 2/1998 |
| WO | WO 98/05739 | 2/1998 |

* cited by examiner

*Primary Examiner*—Walter D. Griffin
(74) *Attorney, Agent, or Firm*—Weingarten, Schurgin, Gagnebin & Lebovici LLP

(57) ABSTRACT

The invention is directed to a process for the hydrogenation of a sulfur containing feedstock, having a sulfur content of less than 50 ppm, wherein the feedstock is hydrogenated in the presence of a precious metal catalyst and a nickel-catalyst, said process being carried out in such a manner, that the feedstock is contacted with a mixture of precious metal catalyst, metal oxide and nickel catalyst, the feedstock is contacted initially with the precious metal catalyst followed by contact with the metal oxide and nickel catalyst, either in combination or sequentially, or the feedstock is contacted first with a mixture of precious metal catalyst and metal oxide, followed by contact with the nickel catalyst.

14 Claims, No Drawings

HYDROGENATION PROCESS

The invention relates to a process for hydrogenating a sulfur containing feedstock, such as resins, petroleum distillates, solvents and the like.

In hydrogenation often a problem presents itself in that the sulfur and/or sulfur components in the feedstock negatively affects the lifetime of the catalyst, especially of nickel catalysts. To avoid this problem much attention has been paid to the removal of sulfur compounds from the gaseous or liquid feedstock prior to the actual hydrogenation and/or dehydrogenation. Further, the presence of sulfur is quite often undesirable in view of the intended use of the hydrogenated material.

In general sulfur impurities are present in feedstocks as mercaptans or thiophenes, which can be hydrogenated to $H_2S$ using a sulfidized Co—Mo catalyst. This method is also known as hydrodesulfurization (HDS). The $H_2S$ formed may then, after separation and concentration, be processed to elemental sulfur in a conventional Claus process. This type of process is used for feedstocks containing large amounts of sulfur, i.e. more than about 0.1 wt. % of sulfur.

After conventional HDS treatment sulfur levels are usually in the range of about 500 ppm. Improved (or deep) HDS processes result in sulfur levels of about 50 ppm, whereas for further purified materials HDS processes have been developed resulting in sulfur contents after treatment of 10 ppm or less.

For some applications even these amounts of sulfur are still too high. In such a situation quite often use is made of a nickel catalyst. This catalyst has a dual function, as on the one hand the material is hydrogenated and on the other hand nickel reacts with the sulfur compounds. In the course of time the nickel will deactivate, and finally will have to be replaced.

In EP-A 398,446 it has been proposed to use a hydrogenation or dehydrogenation catalyst based on at least one hydrogenation component and a metal oxide component, whereby the two components are present on a support as separate particles, preferably in absence of any direct contact between the metal oxide particles and the hydrogenation component particles.

This catalyst provides a good basis for the hydrogenation of various sulfur containing feedstocks. However, a disadvantage of this system resides therein, that the sulfur content of the feedstocks to be treated is limited, thus restricting the applicability.

In WO-A 9703150 a process is disclosed for the hydrogenation of sulfur containing feedstocks, wherein a feedstock having a sulfur content of preferably not more than 300 ppm is first contacted with a precious metal catalyst, followed by contact with a nickel catalyst. This process results therein that the deactivation of nickel is retarded considerably. This process shows a considerable advance in the art, however, for selected feedstocks and/or under specific circumstances further improvement has been considered desirable. More particular this system is suitable for light feeds, such as those that may be hydrogenated at temperatures below 200° C. For heavier feeds, requiring higher temperatures, this system is less suitable.

In the above process it may become a problem that the temperature window within which the process can operate efficiently is rather narrow. At low sulfur contents, quite often temperatures of over 200° C. cannot be used effectively, although this would be advantageous in terms of hydrogenation activity.

It is a first object of the invention to provide a process for the hydrogenation of sulfur containing feedstocks, having a widened temperature window, within which the process may be operated.

It is also an object to provide a process having a further improved tolerance for sulfur in the feedstock, i.e. which can have a longer life time before replacement becomes necessary. It is a further object to provide such a process wherein the deactivation of the catalyst system is retarded considerably.

It is also an object of the invention to provide a system that is very versatile in relation to the possibilities of regeneration and/or recovery of the catalyst components. Another object is to provide a system that may be used in situations where the sulfur content of the feedstock may fluctuate.

The invention is based on the discovery that the combined use of a precious metal catalyst, a nickel catalyst and a metal oxide results in an improved process, especially with respect to the objects stated above. It was found that especially at very low sulfur levels in feedstocks the effectivity of the removal of $H_2S$ by nickel deteriorates.

The invention provides a process for the hydrogenation of a sulfur containing feedstock, having a sulfur content of less than 50 ppm, wherein the feedstock is hydrogenated in the presence of a precious metal catalyst and a nickel-catalyst, said process being carried out in such a manner, that

- the feedstock is contacted with a mixture of precious metal catalyst, metal oxide and nickel catalyst,
- the feedstock is contacted initially with the precious metal catalyst followed by contact with the metal oxide and nickel catalyst, either in combination or sequentially, or
- the feedstock is contacted first with a mixture of precious metal catalyst and metal oxide, followed by contact with the nickel catalyst.

In the broadest sense the process of the invention can be performed by the combined use of all three components, wherein the precious metal will always be used at the start. In preferred embodiments the feedstock will first be hydrogenated using a precious metal catalyst, which is followed either by separate absorption (with metal oxide) and hydrogenation (with nickel) steps, or by a combined hydrogenation-adsorption step. It is, however, also possible to hydrogenate the feedstock using a combination (mixture) of precious metal and metal oxide, followed by nickel. This embodiment is not preferred, as it is more difficult to recover the precious metal catalyst.

It has been found that the present approach to hydrogenating hydrocarbon feedstocks that may contain varying amounts of sulfur impurities, provides a further improvement of the known systems. More in particular it has been found that this process has a high resistance against catalyst deactivation, especially for the treatment of heavy feedstocks, as the system remains stable and useful at higher hydrogenation temperatures, such as over 200° C.

Further the system is highly suitable for the removal of the last traces of sulfur, i.e. at level far below 10 ppm sulfur, for example 1 ppm or less. Conventional systems based on nickel do not result in sufficiently optimal economics of the process.

In the present invention various hydrocarbon feedstocks may be used. Preferred are petroleum distillates, resins, solvents and the like. It is possible to use these feedstocks directly, but it is also possible to use the product from a previous hydrodesulfurisation process, i.e a feedstock having a sulfur content reduced by deep HDS to less than 50 ppm. Surprisingly it has also been found that the system provides advantageous results in case of very low sulfur contents, i.e. below about 10 ppm.

The feedstock is hydrogenated over a conventional precious metal catalyst. Generally these are supported precious metal catalysts, containing from 0.01 to 5.0 wt. %, precious metal calculated on the weight of the catalyst. Preferred amounts are between 0.1 and 2 wt %. The precious metals that may be used are platinum, palladium, rhodium, ruthenium, iridium and alloys thereof, such as platinum-palladium.

As support suitable supports for precious metal catalysts may be used, such as ceramic materials. Examples are silica, alumina, silica-alumina, titania, zirconia, zeolites, carbon, clay materials, combinations thereof and the like.

The metal of the metal oxide component will generally be selected from those metals that react with hydrogen sulfide to give stable metal sulfides. An enumeration of suitable metals has been given in the cited EP-A 398,446. Examples are silver, lanthanum, antimony, bismuth, cadmium, lead, tin, vanadium, calcium, strontium, barium, cobalt, copper, tungsten, zinc, molybdenum, manganese and iron. Preferred metals are zinc and manganese.

As indicated above, there are various possibilities for carrying out the present invention. With respect to all embodiments it is to noted that the steps can be carried out in separate reactors and/or in separate beds of the same reactor(s).

The hydrogenation of the feedstock over a nickel catalyst may be done using any nickel hydrogenation catalyst, such as Raney nickel or a supported nickel catalyst. Under the reaction conditions, the nickel will be mainly in the metallic form. The nickel content may range from as low as 0.5 wt. % to 99 wt. %. A preferred range is from 5 to 70 wt. %, calculated on the total weight of the reduced catalyst. Suitable support materials are the same as for the precious metal catalyst.

The skilled person can easily determine the relative amounts of the various components, depending on the various circumstances, such as sulfur content, type of feedstock and reactor configuration. As a guideline it can be indicated that of the total system (supported precious metal catalyst, nickel catalyst and metal oxide), the amount of precious metal catalyst is preferably between 1 and 30 vol. %. Of the remainder of the system, the weight ratio of nickel catalyst to metal oxide ranges preferably between 20:1 and 1:20. The weight ratio of nickel, calculated as metal, to metal oxide (not being nickel oxide) ranges preferably between 1:10 to 100:1; outside these ranges either the effect on the life time of the system becomes too small to be attractive, or the activity decreases to a level that is economically less interesting.

The above ranges give a general guidance, but variations can be made to optimise the performance of the system.

An important advantage of the present invention resides therein, that it can be implemented in existing plants, without prohibitively high investments. This is especially important for the use of the invention in hydrogenation of solvents. The invention provides the possibility to use existing reactor volumes in an optimal manner, thus reducing costs, while at the same time improving the performance of the system, including the life time of the catalyst, especially when higher conversions are required.

The process of the invention may be carried out at the temperature, pressure and other reaction conditions usually encountered in conventional hydrogenation processes of hydrocarbon feedstocks. Temperatures may accordingly range from 150 to 300° C.; pressures can be from 10 to 250 bar; and LHSV, $H_2$ to feed ratio, and the like are as usual. The amounts of catalyst and metal oxide depend on the amount of unsaturation that has to be removed, on the amount of sulfur and on the other reaction conditions. The skilled person is aware of all these variables and can easily determine the optimal values for the process.

The invention is further elucidated on the basis of the examples, which are intended as exemplary only, without limiting the scope of the invention.

EXAMPLES

In a trickle bed process a heavy solvent, boiling range 180–300° C., containing 8 ppm sulfur was hydrogenated at 30 bar hydrogen pressure. The degree of conversion of aromatics was determined using UV-absorbance at 273 nm.

In a trickle bed reactor a mixture of a supported nickel catalyst and zinc-oxide extrudates was present, on top of which a layer of supported platinum/palladium catalyst was applied.

The nickel catalyst was a 57 wt. % nickel on silica, in the form of 3/64" extrudates. The zinc-oxide extrudates were also 3/64". The precious metal catalyst was an 1.2 wt. % Pt/Pd (weight ratio 1/3) on silica-alumina spheres.

The respective amounts of catalyst were such that in the precious metal the LHSV was 35 $hr^{-1}$ and in the mixture of nickel/zinc-oxide the LHSV was 10 $hr^{-1}$.

The reactor was operated in such a manner, that the decrease in the amount of aromatics in the product, due to deactivation, was kept constant by increasing the inlet temperature, until the maximum temperature of the reactor that can be used in reached (EOR: end of run temperature); in this case 275° C. The relation of sulfur dosage to the reactor and the inlet temperature required to meet the aromatics specification, is a measure for the properties of the catalyst and the resistance against deactivation.

In the following table the temperature versus sulfur dosage of the system of the invention has been given.

| Sulfur dosage (Kg S/M$^3$) | Temperature (° C.) |
|---|---|
| 1 | 165 |
| 2 | 183 |
| 3 | 198 |
| 4 | 207 |
| 5 | 216 |
| 6 | 223 |
| 7 | 228 |
| 8 | 230 |
| 9 | 232 |
| 10 | 238 |
| 12 | 241 |
| 14 | 254 |

What is claimed is:

1. Process for the hydrogenation of a sulfur containing feedstock, having a sulfur content of less than 50 ppm, wherein the feedstock is hydrogenated in the presence of a precious metal catalyst, the precious metal being selected from platinum, palladium, rhodium, ruthenium, iridium, osmium and alloys thereof, such as platinum-palladium, and a nickel-catalyst, said process being carried out in such a manner, that the feedstock is contacted initially with the precious metal catalyst followed by contact with a metal oxide and the nickel catalyst, either in combination or sequentially, and wherein the metal oxide has been selected from the oxides of silver, lanthanum, antimony, bismuth, cadmium, lead, tin, vanadium, calcium, strontium, barium, cobalt, copper, tungsten, zinc, molybdenum, manganese and iron.

2. Process for the hydrogenation of a sulfur containing feedstock, having a sulfur content of less than 50 ppm, wherein the feedstock is hydrogenated in the presence of a precious metal catalyst, the precious metal being selected from platinum, palladium, rhodium, ruthenium, iridium, osmium and alloys thereof, such as platinum-palladium, and a nickel-catalyst, said process comprising contacting the feedstock first with a mixture of precious metal catalyst and metal oxide, followed by contact with the nickel catalyst, and wherein the metal oxide has been selected from the oxides of silver, lanthanum, antimony, bismuth, cadmium, lead, tin, vanadium, calcium, strontium, barium, cobalt, copper, tungsten, zinc, molybdenum, manganese and iron.

3. Process according to claim 1, wherein the sulfur content of the feedstock is less than 10 ppm.

4. Process according to claim 1, wherein the feedstock, after hydrogenation with the precious metal catalyst and before the hydrogenation with the nickel catalyst is contacted with the metal oxide.

5. Process according to claim 1, wherein the feedstock is simultaneously contacted with the metal oxide and the nickel catalyst.

6. Process according to claim 1 or claim 2, wherein the precious metal catalyst is a supported catalyst.

7. Process according to claim 6, wherein the support of the precious metal catalyst is selected from silica, alumina, silica-alumina, titania, zirconia, zeolites, carbon, clay materials and combinations thereof.

8. Process according to claim 1 or claim 2, wherein the precious metal content of the catalyst is between 0.01 and 5.0 wt. %, calculated on the weight of the catalyst.

9. Process according to claim 1 or claim 2, wherein the nickel catalyst is Raney nickel or a supported nickel catalyst containing from 0.5 to 99 wt. % nickel.

10. Process according to claim 1 or claim 2, wherein the amount of precious metal catalyst ranges from 1 to 30 vol. % of the total system.

11. Process according to claim 1 or claim 2, wherein the weight ratio of nickel catalyst to metal oxide is between 20:1 and 1:20.

12. Process according to claim 1 or claim 2, wherein the feedstock is selected from petroleum distillates, resins and solvents.

13. Process according to claim 2, wherein the sulfur content of the feedstock is less than 10 ppm.

14. Process according to claim 1 or claim 2, wherein:

the precious metal catalyst is a supported catalyst;

the support of the precious metal catalyst is selected from silica, alumina, silica-alumina, titania, zirconia, zeolites, carbon, clay materials and combinations thereof;

the precious metal content of the catalyst is between 0.01 and 5.0 wt. %, calculated on the weight of the catalyst;

the nickel catalyst is Raney nickel or a supported nickel catalyst containing from 0.5 to 99 wt. % nickel;

the amount of precious metal catalyst ranges from 1 to 30 vol. % of the total system;

the weight ratio of nickel catalyst to metal oxide is between 20:1 and 1:20;

the sulfur content of the feedstock is less than 10 ppm; and the feedstock is selected from petroleum distillates, resins and solvents.

* * * * *